United States Patent [19]

Zalewski

[11] 4,387,481

[45] Jun. 14, 1983

[54] SOOT BLOWER

[75] Inventor: Gerald F. Zalewski, Albion, Pa.

[73] Assignee: White Consolidated Industries, Inc., Cleveland, Ohio

[21] Appl. No.: 234,982

[22] Filed: Feb. 17, 1981

[51] Int. Cl.[3] ..... F23J 3/02

[52] U.S. Cl. ..... 15/316 R; 104/183; 242/157 R

[58] Field of Search ..... 15/316 R, 316 A, 317, 15/318, 315; 242/157; 104/173 R, 183, 184

[56] References Cited

U.S. PATENT DOCUMENTS

| | | | |
|---|---|---|---|
| 2,301,208 | 11/1942 | Gear | 15/315 X |
| 2,585,776 | 2/1952 | Hermanek | 19/109 |
| 2,595,655 | 5/1952 | Hannay | 15/315 X |
| 2,604,358 | 7/1952 | Richards | 15/317 X |
| 3,208,729 | 9/1965 | Townsen | 242/157 R X |
| 4,165,552 | 8/1979 | Johnston | 15/316 R X |

FOREIGN PATENT DOCUMENTS

| | | | |
|---|---|---|---|
| 203041 | 5/1956 | Australia . | |
| 727426 | 12/1966 | Italy | 104/183 |

*Primary Examiner*—Chris K. Moore

*Attorney, Agent, or Firm*—Mandeville and Schweitzer

[57] ABSTRACT

The disclosure is directed to a soot blower of the long retracting type. In accordance with the invention, a novel cable drive system is provided to impart a traverse motion to the lance tube of the soot blower. The cable drive system comprises a rotatable, cable-supporting drum, a first cable including one end fastened to the drum and extending from the drum to an operative connection with the traveling carriage supporting the soot blower lance tube and a second cable including an end fastened to the drum and extending from the drum to an operative connection with the traveling carriage on a side thereof opposite to the side which is connected to the first cable. The drum is selectively rotatable in a clockwise or counterclockwise direction and rotation of the drum is operative to move the traveling carriage in an advancing or retracting direction along a predetermined path of travel. Pursuant to a significant feature of the invention, the rotatable drum is positioned at a location midway between the forwardmost and rearwardmost ends of the predetermined path of travel. The soot blower of the invention also includes an automatic cable guide system to guide the drive cables onto and off of the drum, a revolving roller assembly to support and guide the lance tube during its working motion along the predetermined path of travel and a novel valve and valve actuator operable to provide a cleaning fluid flow to the lance tube at appropriate times during its working motion.

7 Claims, 15 Drawing Figures

SOOT BLOWER

BACKGROUND AND SUMMARY OF THE INVENTION

The invention is directed to a soot blower for cleaning the interior surfaces of a boiler by discharging a suitable cleaning fluid from a nozzle against such surfaces. More particularly, the invention relates to new and improved mechanisms for driving and guiding the lance tube mounting the fluid discharge nozzle of the soot blower from a non-working position forwardly through a working motion and return.

Typically, in a soot blower of the long retracting type, a lance tube is moved through a long, e.g., 65 foot path of travel horizontally forward into the heat exchange zone of a large public utility boiler. During the traveling motion of the lance tube, the tube is rotated about its longitudinal axis and a cleaning fluid is discharged through a nozzle mounted at the forwardmost end of the tube so that the fluid may be directed against various internal surfaces of the boiler to remove undesirable soot accumulations. Accordingly, various means are required for imparting movement to the lance tube and for guiding the long lance tube as it enters and leaves the boiler.

It is one objective of the present invention to provide a novel cable drive system for the lance tube. Generally, the system comprises a two-cable arrangement having first and second drive cables. The first cable includes one end fastened to the traveling carriage which supports the lance tube for horizontal movement. The first cable extends from the traveling carriage around the pulley of a cable tensionêr, mounted proximate to the rearmost non-working position occupied by the traveling carriage, to a fastened relation with a rotatable drum of a traversing drive assembly. The second cable also includes an end fastened to the traveling carriage and extends from the traveling carriage around the pulley of a second cable tensioner, mounted near the forwardmost position occupied by the traveling carriage, to a fastened relation with another part of the rotatable drum. In accordance with a feature of the invention, the rotatable drum is provided with a grooved cylindrical cable-receiving surface so that several complete cable wraps of each of the first and second cables may be wound around the rotatable drum.

A suitable electric drive motor is mechanically connected to the rotatable drum through appropriate gearing mechanisms whereby the drum may be driven through a clockwise or counter-clockwise rotation. When the rotatable drum is rotated through a clockwise rotation, the second cable is taken up by the rotating drum causing the cable to pull the traveling carriage forwardly, thereby advancing the lance tube into the boiler. When the lance tube has been fully inserted into the boiler, the rotatable drum may then be rotated in the counter-clockwise direction causing the first cable to be wound onto the drum whereby the first cable will pull the traveling carriage rearwardly back towards the non-working position, thereby retracting the lance tube from the boiler. Pursuant to the invention, the rotatable cable drum is positioned midway between the rearwardmost and forwardmost points on the path of travel for the traveling carriage. Accordingly, the length of each of the first and second cables may be kept at a minimum. The central location of the rotatable drum and relatively short length for each of the cables minimizes unwanted vibrations and harmonics which may develop during operation of the cable drive system. Moreover, the grooved surface for the cable drum prevents any section of either of the cables from coming into direct contact with any other section of the cables to eliminate cable scrubbing. This reduces wear and tear on the cables and lengthens the worklife of the cables. To advantage, the cable tensioners are adjustable to accommodate cable stretch thereby avoiding sagging of the cables to assure long term successful operation of the cable drive.

As another feature of the invention, a movable guide system is provided to guide the cables onto and off the rotatable drum. The guide assembly includes traveling assemblies that follow a complementary cable across the surface of the drum to insure that the cable is properly received in the grooved portions of the drum surface. The assemblies also tend to dampen any vibrations in the cables to facilitate their motion onto and off the drum. This acts to further reduce wear and tear on the cables and permits the cables to be positioned close to the top of the soot blower housing with sufficient clearance for the cable to pass into and out of the housing.

In accordance with another significant feature of the invetion, a revolving roller assembly is provided to guide the lance tube into and out of the boiler. The revolving roller assembly is mounted adjacent the boiler at the lance-tube-receiving opening thereof and comprises three rotatable rollers, each including a generally concave surface. The rollers are rotatably mounted in a circular frame with each roller being in a spaced, opposed relation to the other rollers. The rollers are arranged and configured whereby the axis of each of the rollers forms an angle of approximately 60° with the axis of each of the adjacent two rollers. In this manner, the concave surfaces of the opposed rollers define a generally circular central opening whereby the lance tube may be received through the opening to be supported and guided by the rotatable rollers into the boiler. The circular frame mounting the rollers is in turn rotatably mounted in a supporting structure so that, as the rotating lance tube is guided into the boiler by the rollers, the entire circular roller supporting frame may be rotated with the lance tube to substantially reduce friction between the lance tube and guiding rollers.

During the horizontal movement of the long lance tube, the tube is guided through a curved path of travel outside the boiler so that the torque developed by the free nozzle end of the tube, as it moves forwardly and upwardly into the boiler, will counteract the upward motion the curved path tends to impart to the nozzle. The net effect is to maintain the nozzle in a generally more linear path within the boiler and to prevent the nozzle from drooping excessively as it advances toward its furthest position within the boiler.

In a typical soot blower of the long retracting type, a feed pipe is arranged in a co-axial, telescoping relation with the lance tube to provide fluid communication between the lance tube and a source of cleaning fluid. The above-described curved path of travel for the lance tube tends to bend the feed pipe into a curved pipe, thereby creating large, concentrated radial loads between the forwardmost end of the feed pipe and the lance tube. These concentrated loads cause high friction and excessive bearing wear and eventually lead to scratching of the feed pipe, packing failure and fluid leakage. Pursuant to another feature of the invention, the adverse radial load is greatly eliminated by a self-aligning feed pipe bushing interposed between the forwardmost end of the feed pipe and the lance tube. The bushing includes novel spherical radii cut into the outer diameter of the bushing whereby the bushing may follow the bend of the curved feed pipe and distribute the load over a greater area.

Another advantageous feature of the invention includes an improved valve assembly arranged between the feed pipe and the source of cleaning fluid. Generally, the valve assembly comprises an unbalanced main valve plug with the high pressure of the fluid on the input side of the valve plug tending to hold the plug in a closed position. The plug includes a smaller, inner auxiliary plug which is opened initially to equalize pressure on both sides of the plug so that when the main plug is lifted from the valve seat, there are no great unbalanced fluid pressure forces resisting the opening movement. Thus, the unbalanced valve assembly will insure a tight, closed condition for the valve while the inner plug arrangement facilitates an easy valve opening and closing operation.

The present invention provides several features, each with numerous advantages to enhance the effectiveness and reliability of a soot blower in achieving its intended purpose. The many features of the invention compliment one another in an overall system for driving and guiding the lance tube resulting in smooth and efficient operation. The cable drive offers a straightforward traverse motion for the lance tube while the revolving roller assembly facilitates low friction entry of the lance tube into the boiler. These features, when coupled with the wear-reducing effects of the novel self-aligning feed pipe bushing and the efficacious operation of the unbalanced valve plug insure long term, dependable boiler cleaning by the soot blower.

For a better understanding of the above and other features and advantages of the invention, reference should be made to the following detailed description of a preferred embodiment of the invention and to the accompanying drawings.

DETAILED DESCRIPTION OF A PREFERRED EMBODIMENT

Figure 1A:
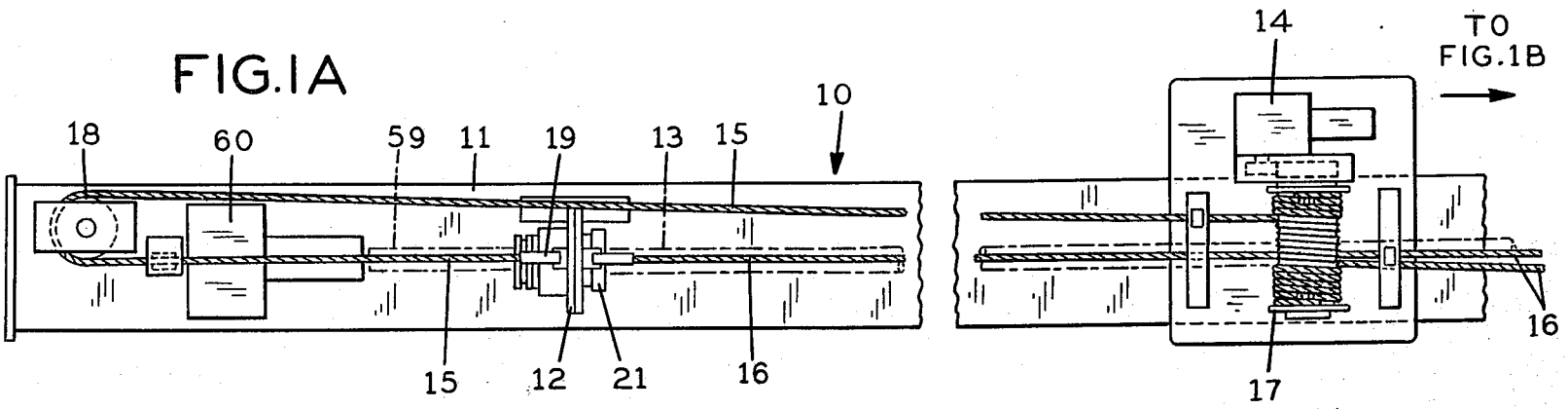
FIGS. 1A and 1B together illustrate a plan view of a soot blower of the long retracting type including a cable drive system of the present invention.

Referring now to the drawings, and initally to FIGS. 1A, B and 2A,B, there is illustrated a soot blower generally indicated by the reference numeral 10. The soot blower 10 includes a main support frame 11 which defines a long, housing-type channel to mount a horizontally movable traveling carriage 12, as will appear. The traveling carriage 12 in turn rotatably supports a long, hollow rotatable lance tube 13 such that horizontal movements of the carriage 12 will advance the lance tube 13 through a working motion and return. The housing 11 is mounted adjacent the heat exchange portions of a large public utility boiler (not specifically illustrated) in a well known manner with the lance tube 13 being arranged and configured to travel from the housing 11 to the interior portions of the boiler to perform a soot removal operation, as discussed above. A revolving roller assembly 73, to be described in more detail below, is mounted at the forwardmost end of the housing 11 to support and guide the lance tube 13 as it travels into and out of the boiler.

I. CABLE DRIVE SYSTEM

In accordance with the invention, horizontal motion is imparted to the traveling carriage 12 by a cable drive system generally comprising a traversing drive assembly 14 and first and second drive cables 15, 16. The first drive cable 15 includes an end fastened to a rotatable drum 17 of the drive assembly 14 and is wrapped around the drum 17 through several complete turns. The cable 15 extends from the drum to an idler pulley 18 which is adjustably fastened to the rear wall of the main support frame 11. The adjustment of the idler pulley 18 may be accomplished by any suitable known mechanical expedient which permits the idler pulley 18 to be selectively fixed in a predetermined horizontal position. In the preferred embodiment, a sheave box assembly with a rear adjusting screw is utilized to adjustably mount an idler pulley 18 to the housing structure 11. The idler pulley 18 may therefore function as a cable tensioner to maintain the drive cable 15 in a taut condition. The cable 15 extends from the idler pulley 18 to a rigid connection by cable connector 19 to the traveling carriage 12.

Figure 1B:
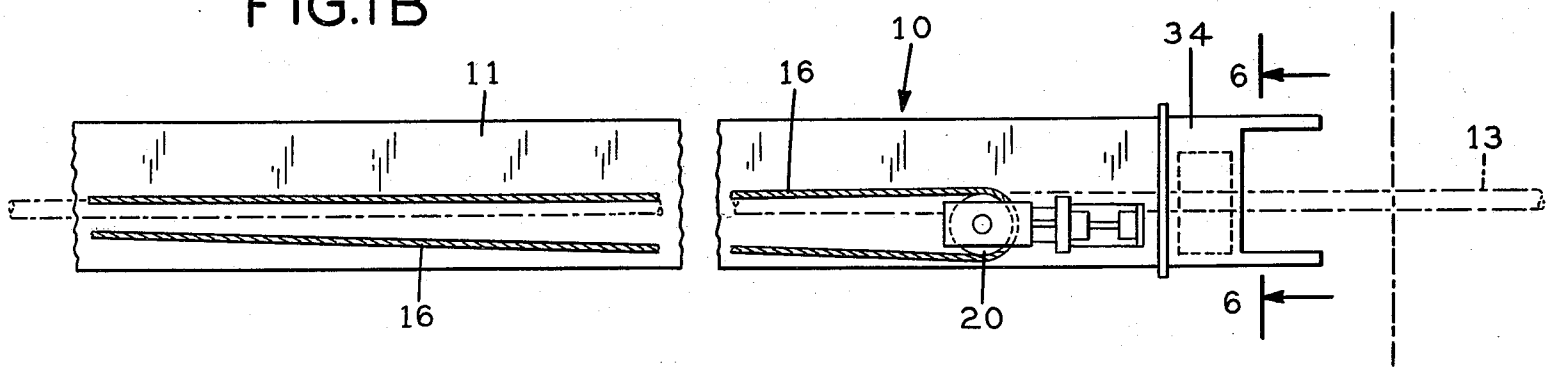
Figure 2A:
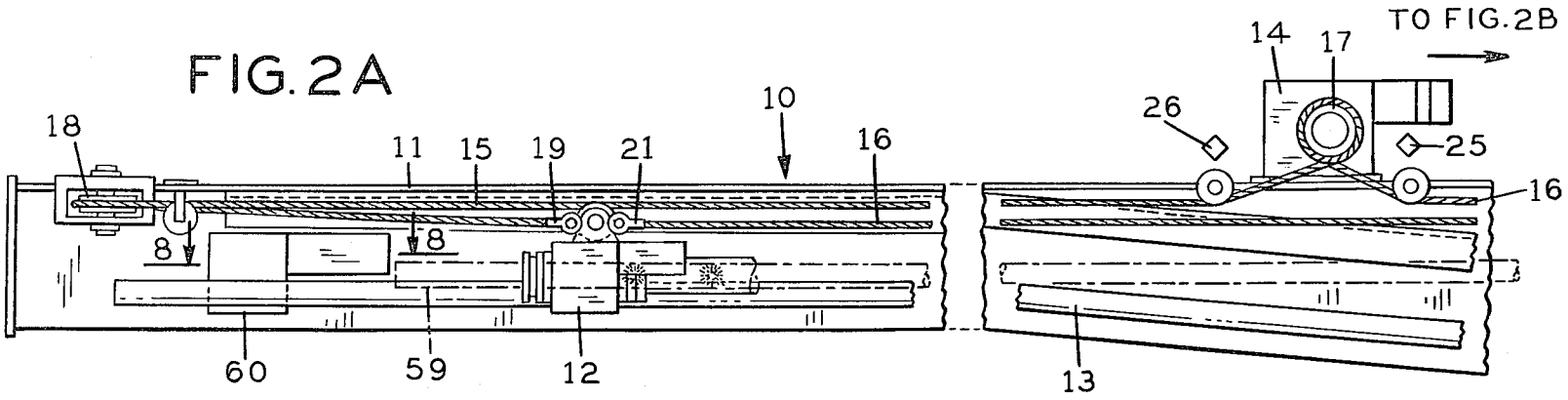
FIGS. 2A and 2B when taken together provide a side view of the soot blower of FIG. 1.
Figure 2B:
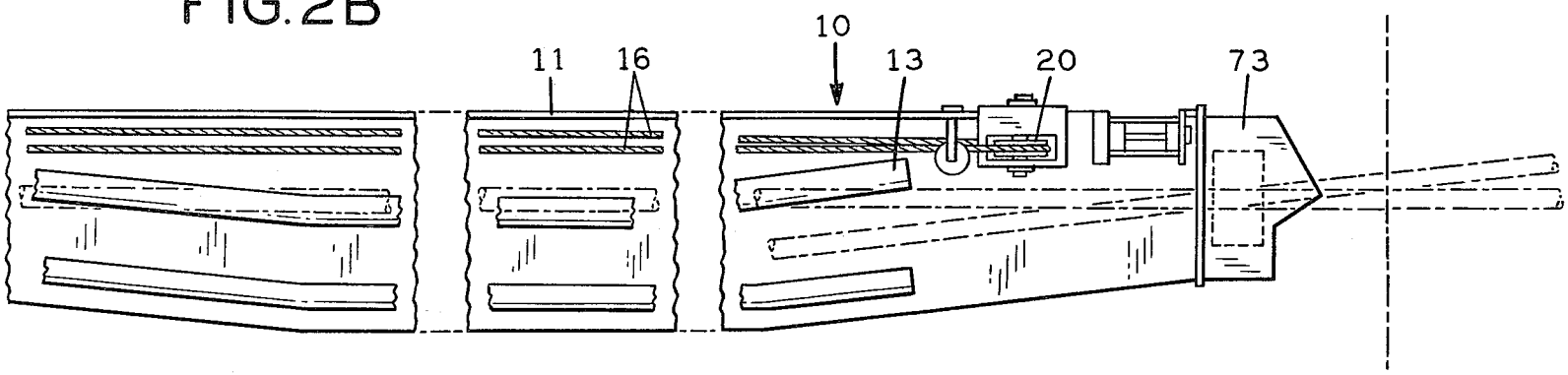

In a similar manner, the second drive cable 16 is mounted to the rotatable drum 17 and extends after several turns around the drum 17 from the drum 17 to a second idler pulley 20 adjustably mounted at the forwardmost end of the main support structure 11. From the second idler pulley 20 the cable 16 continues to a rigid connection via cable connector 21 to the traveling carriage 12. As clearly illustrated in FIGS. 1 and 2, the drive cables 15, 16 are connected to the traveling carriage 12 whereby they form a 180° angle with respect to one another. In this manner, the second drive cable 16 may be utilized to pull the traveling carriage 12 in a forward direction and the first drive cable 15 may act to pull the traveling carriage in a reverse direction.

Figure 3:
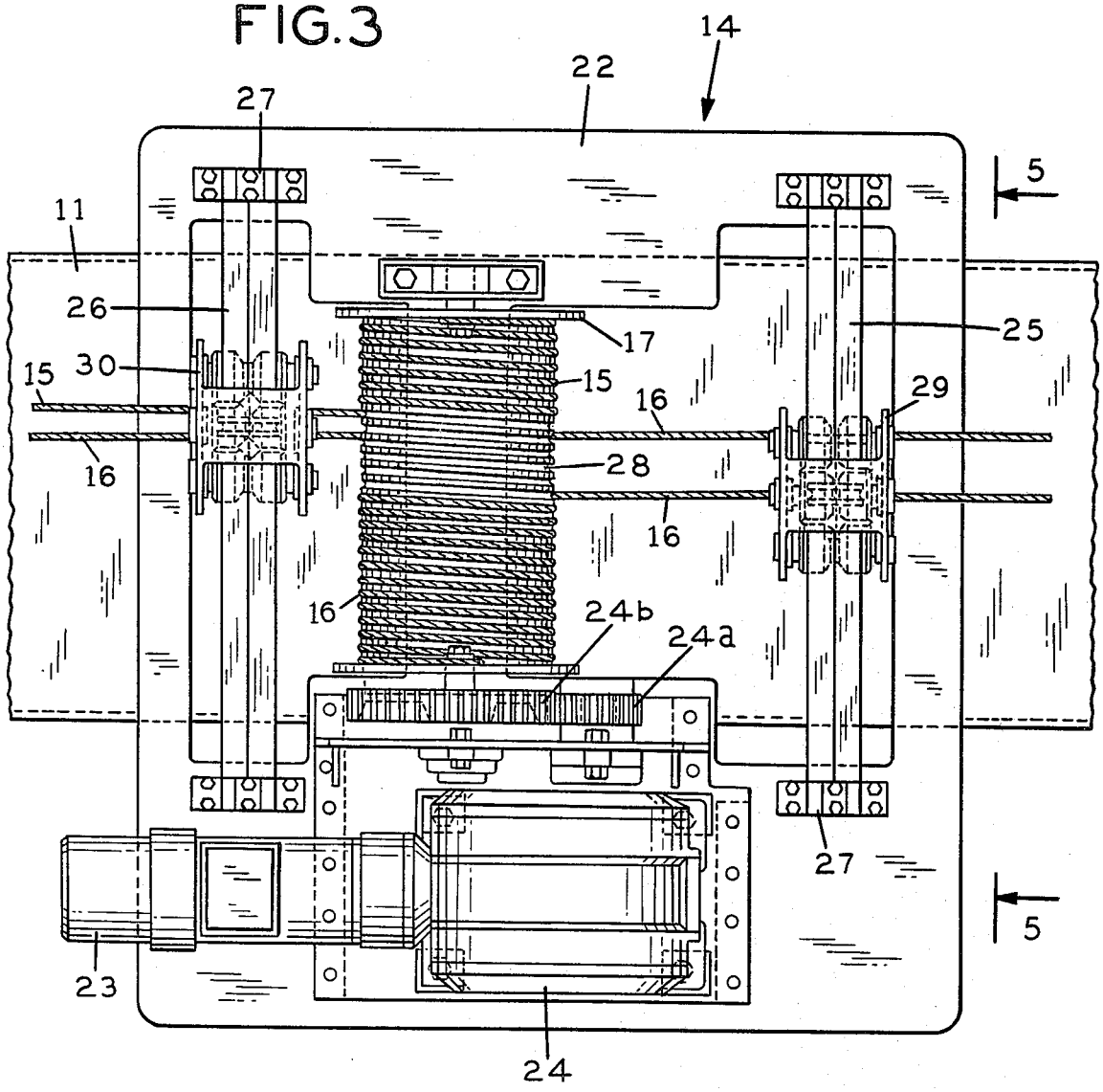
FIG. 3 is a plan view of the traversing drive assembly for the cables of the cable drive system.
Figure 4:
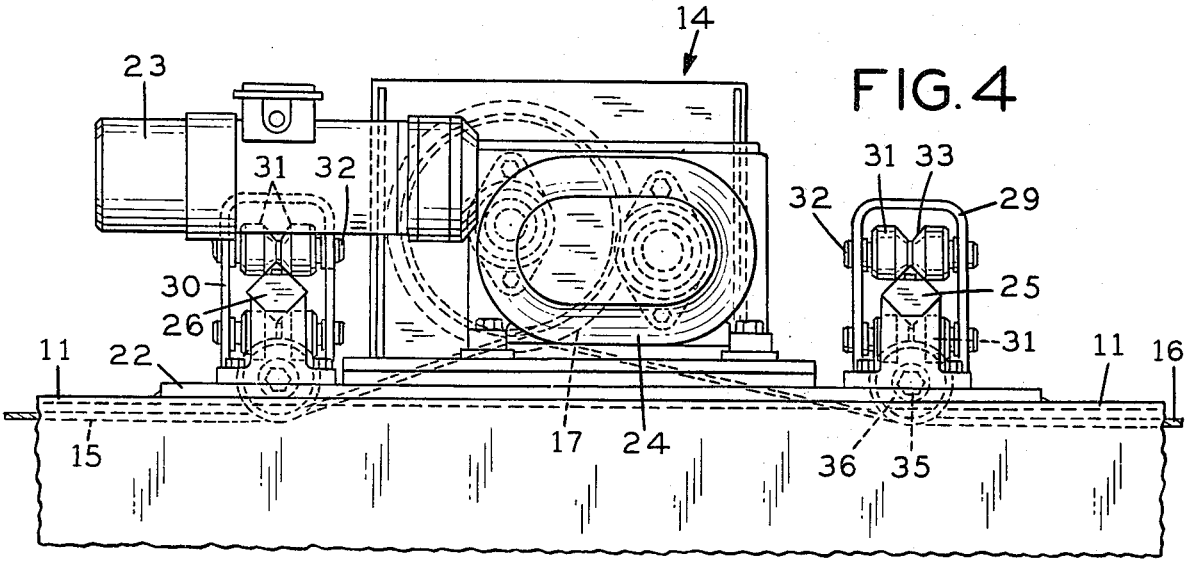
FIG. 4 is an end view of the traversing drive assembly of FIG. 3.
Figure 5:
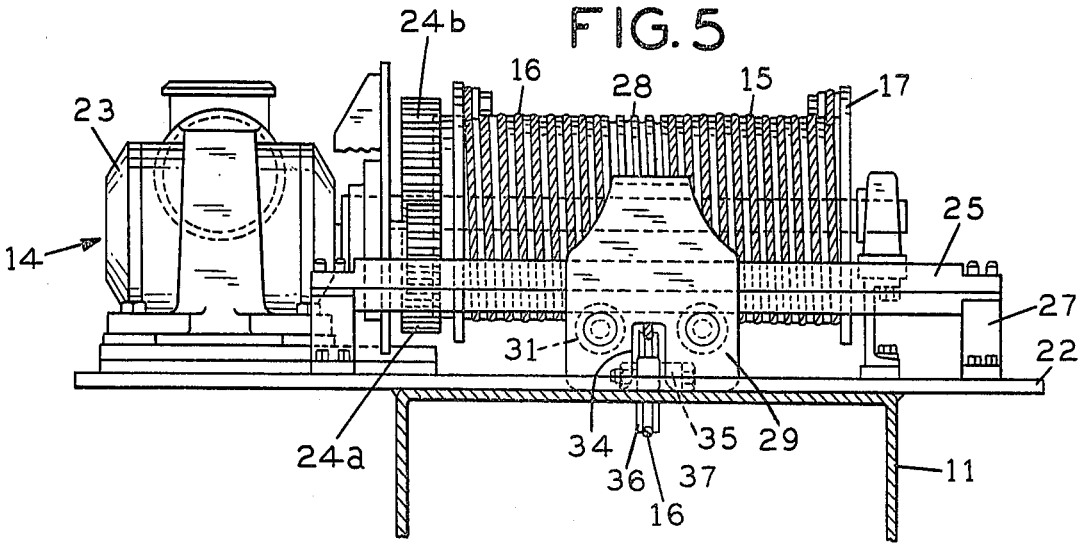
FIG. 5 is a side view of the traversing drive assembly of FIG. 4.

Referring now more particularly to FIGS. 3 through 5, the various components of the traversing drive assembly 14 are mounted on a flat support platform 22 which is attached to the housing-like support frame 11 as by welding. The working components of the traversing drive assembly 14 include an electric motor 23 which is mechanically coupled to the rotatable cable drum 17 by a suitable gear box 24 and gears 24*a*, 24*b*. The rotatable drum 17 is provided with a grooved cable-receiving surface 28. The grooved pattern of the surface 28 is of a generally continuous helical configuration so that as the drive cables 15, 16 are received onto the drum 17, they fit within the groove and are separated from adjacent turns of the cables 15, 16 on the drum to prevent the cables 15, 16 from scraping against themselves and one another. This reduces friction and lengthens the worklife of the cables 15, 16.

As should be understood, counter-clockwise rotation of the cable drum 17 by the motor 23 will wind the second cable 16 onto the drum causing the second cable 16 to pull the traveling carriage 12 in a forward direction to advance the lance tube 13 into the boiler. Clockwise rotation of the rotatable cable drum 17 will have the opposite effect, that is, to pull the first cable 15 onto the drum whereby the first cable 15 will pull the traveling carriage 12 in a reverse direction to retract the lance tube 13 from the boiler. In either rotational direction of the cable drum 16, the non-pulling cable will unwind from the drum in an amount equal to the amount that the pulling cable is being wound onto the drum so that the end of the non-pulling cable fastened to the traveling carriage 12 will move the carriage and not resist the pulling effect of the then pulling cable. Accordingly, the present invention provides a mechanically straightforward means for advancing and retracting the lance tube 13 for a soot blowing operation. Moreover, as evident in FIGS. 1 and 2, the traversing drive assembly 14 is mounted on the housing 11 at an area generally midway between the rearwardmost and forwardmost point on the path of travel for the traveling carriage 12. In this manner, the lengths of the drive cables 15, 16 are minimized to reduce the cost and complexity for assembling the soot blower. In addition, test runs on a prototype of the invention indicate that the central location for the rotatable drum 17 and relatively short lenghts for the drive cables 15, 16 provide a smooth operation with minimal harmonics and vibrations developing in the drive cables 15, 16.

II. AUTOMATIC CABLE GUIDE SYSTEM

As another significant feature of the invention, an automatic guide system is provided adjacent the traversing drive assembly 14. The guide system comprises a pair of horiontally disposed, diamond-shaped tracks 25, 26 which are mounted to the horizontal platform 22 by support blocks 27. Each of the diamond-shaped tracks 25, 26 is arranged in an opposed, spaced axially-aligned relation to the cable receiving surface 28; one on each side of the drum 17. A roller assembly 29, 30 is movably mounted on each of the tracks 25, 26, with each roller assembly including three pairs of rollers 31.

All of the rollers 31 are rotatably mounted on a complementary axle 32 and include one end 33 formed to a truncated, conical configuration. Each pair of rollers 31 is arranged on the complementary axle 32 such that the conical ends 33 of the rollers 31 of the particular pair face one another to define a V-shaped track engaging surface. One pair of rollers 31 is mounted on an axle 32 disposed above the track 25, 26 to thereby engage the upper surface of the track 25, 26 and the other two pairs are mounted on axles 32 disposed below the track 25, 26 to thereby engage the lower surface of the track 25, 26. Accordingly, the roller assemblies 29, 30 are movable back and forth along their respective tracks 25, 26.

Pursuant to the invention, each roller assembly 29, 30 is formed with a transversely disposed, slot-like recess 34 to mount a shaft 35. A pulley 36 is rotatably supported by each shaft 35 and includes a cable receiving portion 37. The drive cables 15, 16 are arranged to engage the respective pulley 36 on the side of the drum 17 from which the particular cable 15, 16 is wound onto the grooved cable receiving surface 28. The taut condition of the cables 15, 16 insures that the cables 15, 16 remain in the cable receiving portion 37 of the pulleys 36 and the cables 15, 16 travel from the complementary pulley 36 to the drum 17.

As the pulling or non-pulling cable 15, 16 is wound onto or off of the drum 17, the particular cable will move transversely to the drum surface 28 and the roller 30 will accordingly move along the respective track 25, 26 to follow and guide the cable 15, 16 via the pulleys 36 onto or from the drum 17. The pulleys 36 will dampen any vibrations which may develop in the moving cables 15, 16 to facilitate a smooth motion for the cables 15, 16 as they move on or off the grooved surface 28 and also insure that the cables 15, 16 are properly received in the helical groove of the surface 28. Moreover, the use of track engaging rollers 31 above and below the tracks 25, 26 stabilizes the roller assemblies 29, 30 to afford highly reliable service.

III. TRAVELING CARRIAGE

Figure 9:
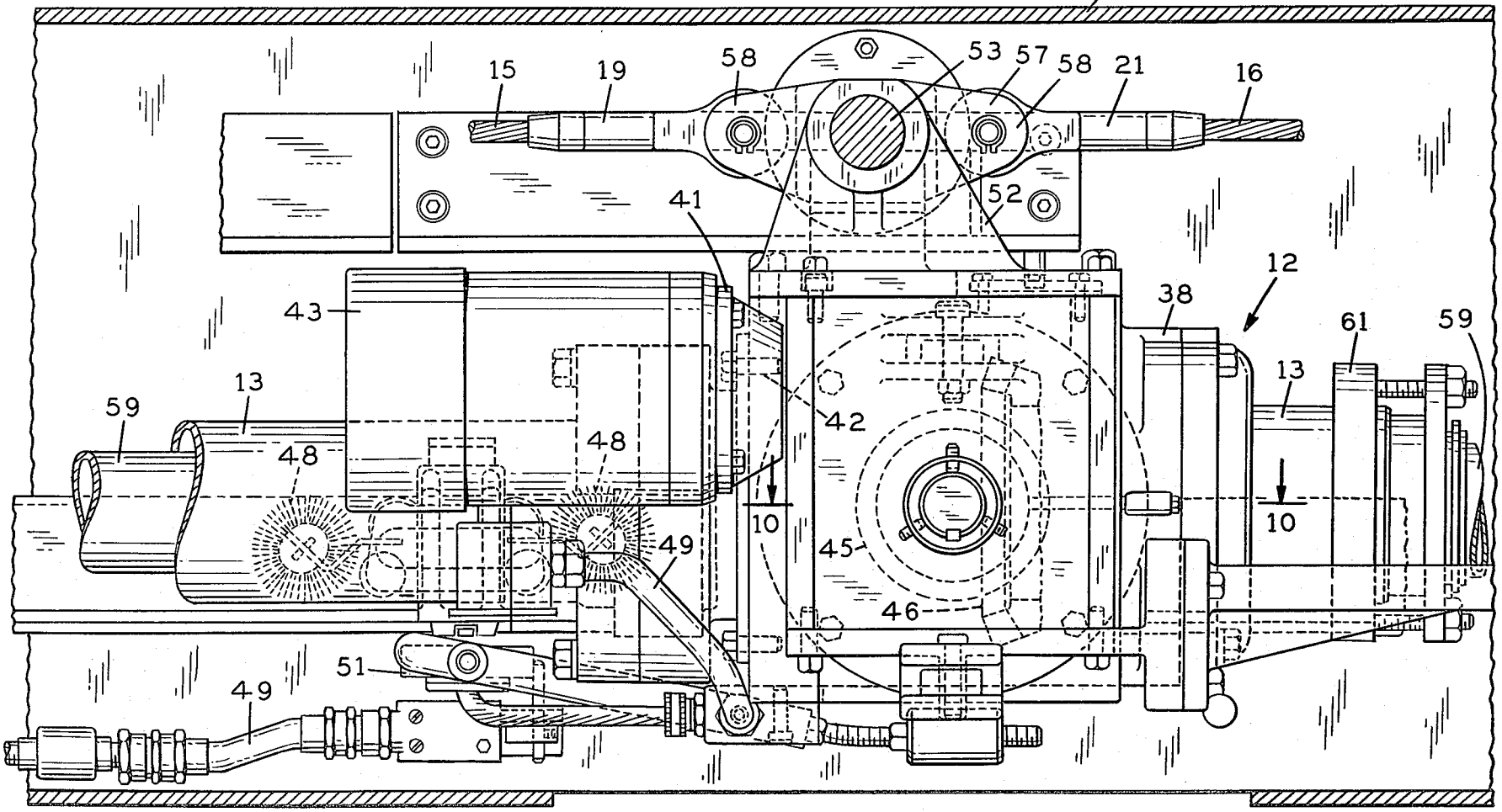
FIG. 9 is a side view of the traveling carriage assembly of the soot blower illustrated in FIG. 1.
Figure 10:
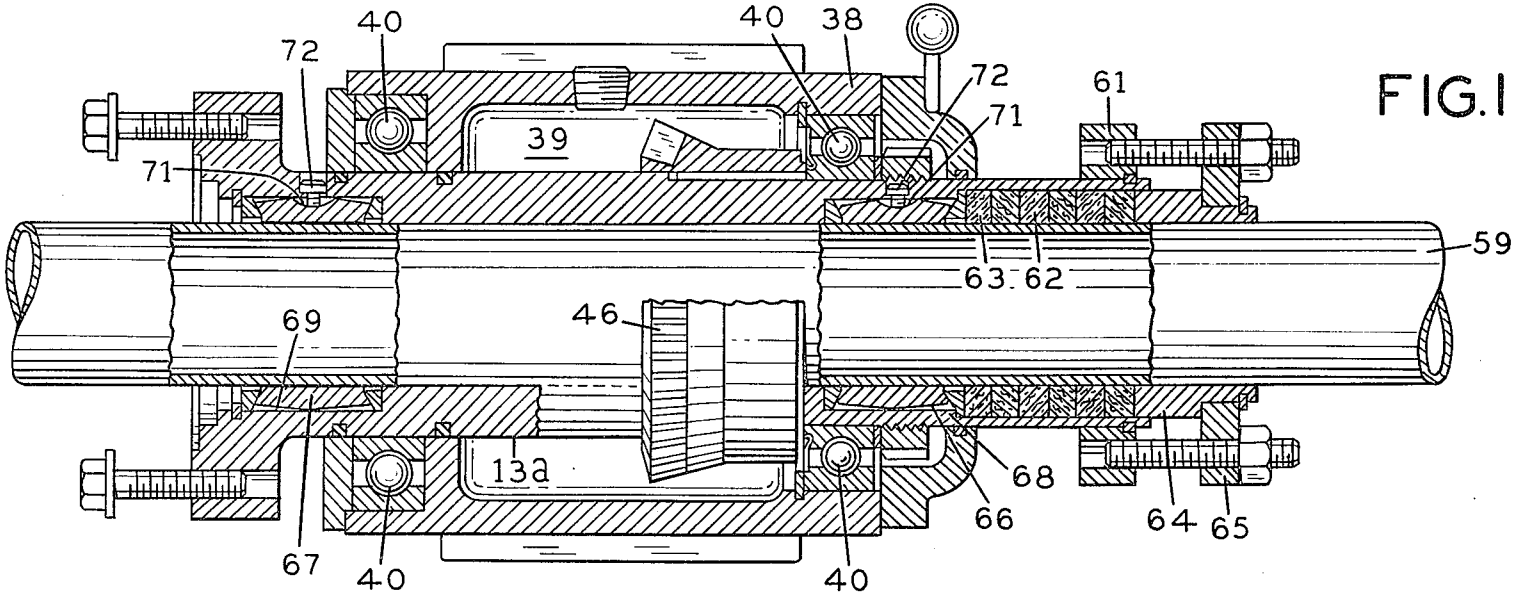
FIG. 10 is a partial, side cross sectional view of FIG. 9 taken generally along line 10—10 of FIG. 9.
Figure 13:
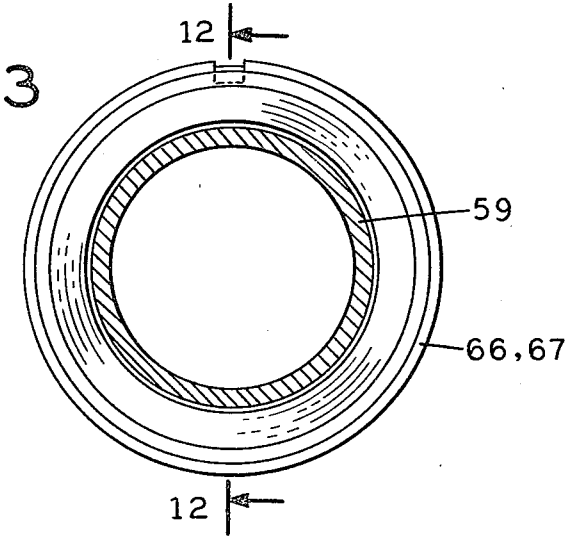
FIG. 13 is an end view of the bushing of FIG. 11.
Figure 12:
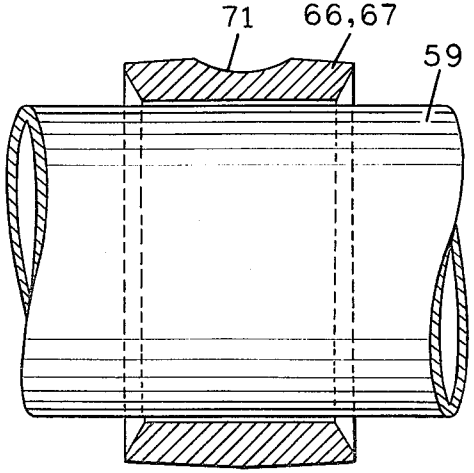
FIG. 12 is a side cross sectional view of the self-aligning bushing of the present invention.
Figure 11:
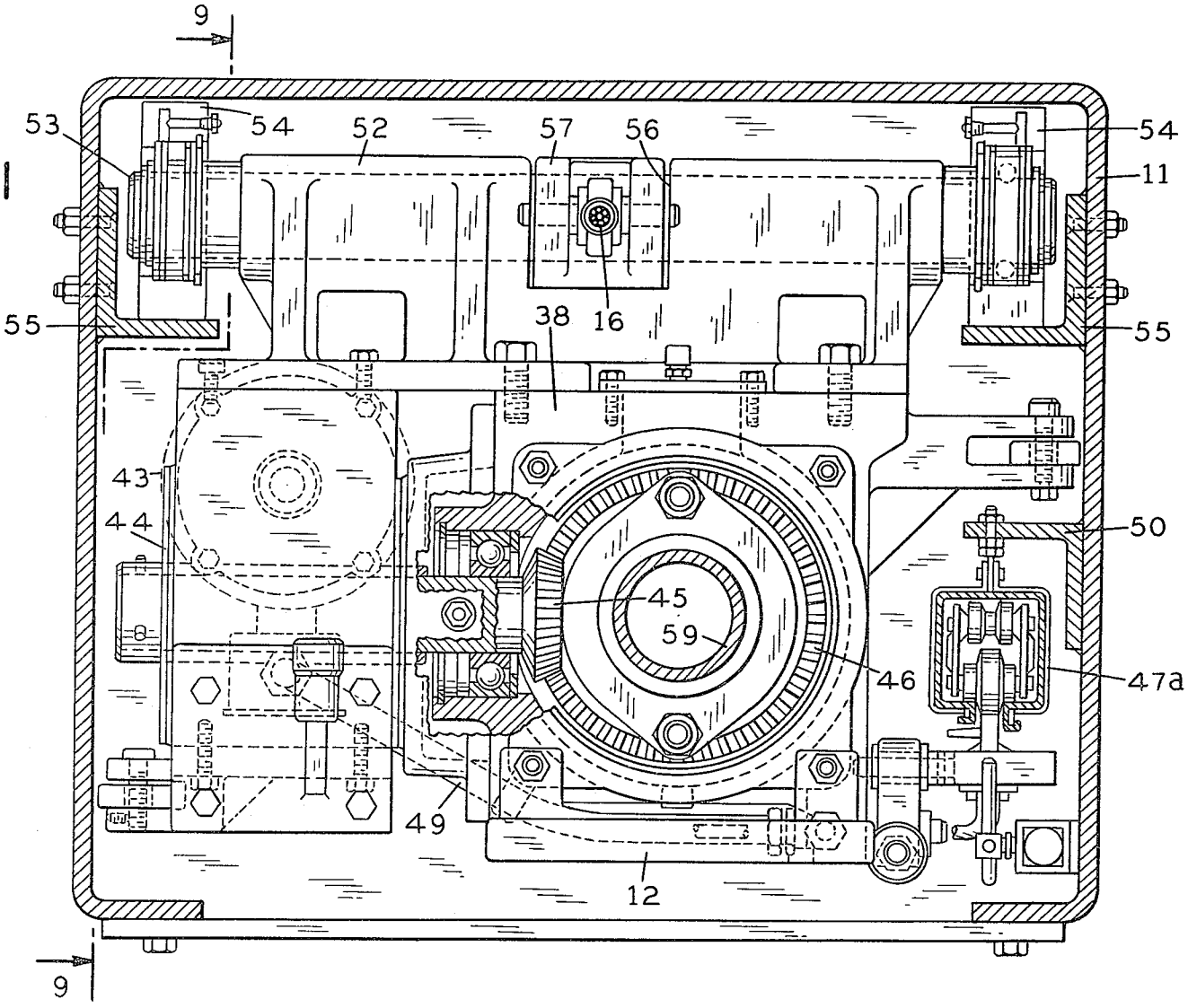
FIG. 11 is an end view of the traveling carriage of FIG. 9.

Referring now to FIGS. 9 through 11, there is illustrated in detail the traveling carriage assembly 12 for the lance tube 13. The carriage 12 includes a main frame structure 38 provided with a hollow, cylindrical section 39 (FIG. 10) to rotatably support the lance tube 13. A set of ball bearings 40 are interposed between the lance tube 13 and annular recesses formed within the cylindrical section 39 so that the lance tube 13 is securely mounted and freely rotatable within the traveling carriage 12.

A support extension 41 is mounted to the main frame structure 38 by threaded bolts 42 to support a rotary drive electric motor 43. The motor 43 is mechanically connected through a speed reducing gear box 44 to a bevel pinion gear 45 which is in a meshing engagement with a bevel gear 46 mounted about the outer circumference of the lance tube 13. Operation of the motor 43 will thereby impart a rotary motion to the lance tube 13.

To advantage, electrical power is provided for the motor 43 by an electrical rail 47 mounted to and running the full length of the housing 11. The electric rail 47 is enclosed in a housing 47A which is supported from L-shaped brackets 50 welded to the housing 11. A set of brush contacts 48 are mounted to the main structure 39 of the carriage 12 by member 51 and extend from the member 51 to within the rail housing 47A to engage the rail 47. Suitable electric cables 49 interconnect the brush contacts 48 with the motor 43 to energize the motor 43 when desired. A cross beam member 52 is mounted to the top of the main structure 38 and supports an axle 53. The axle 53 extends from each side of the cross beam member 52 to mount a set of wheels 54. The wheels 54 are arranged to engage track forming, L-shaped members 55 bolted to and extending the full length of the housing 11. In this manner, the carriage 12 may be moved horizontally through the housing to advance and retract the lance tube 13.

The cross beam member 52 includes a cut-out portion 56 whereby a cable connector member 57 is pivotally supported on an exposed portion of the axle 53. The cable connector member 57 includes two outwardly extending wings 58, each of which hingedly mounts one of the cables 15, 16 to the carriage via the cable connectors 19, 21, respectively. The pulling action of the cables 15, 16, as described above, will pull the axle 53 so that the wheels 54 roll along the tracks 55 moving the carriage 12 through the housing 11.

IV. FEED PIPE BUSHINGS

In accordance with conventional design of a soot blower of the long retracting type, a feed pipe 59 is arranged in a co-axial, telescoping relation with the lance tube 13. The rearwardmost end of the feed pipe 59 is connected to a valve assembly 60 (see FIG. 1) whereby a cleaning fluid, such as water, steam or air, may be fed through the feed pipe 59 to the lance tube interior, as will appear. The feed pipe 59 is of sufficient length to maintain fluid communication between the valve assembly 60 and the lance tube interior for the full advancing motion of the lance tube 13.

Referring once again to FIGS. 9 and 10, the end of the lance tube support 13*a* is provided with a gland mounting plate 61. Suitable packing material 62 is placed within a rearwardly extending annular recess 63 formed in the interior surface of the lance tube support 13*a* to provide a leak-tight seal between the lance tube support and the co-axial feed pipe 59. Accordingly, the cleaning fluid discharged into the lance tube interior by the feed pipe 59 will not be able to flow out the rear end of the lance tube support. A packing gland 64 is positioned in a co-axial relation with the end of the lance tube support 13*a* and is pressed against the packing material 62 by a gland follower 65 to maintain the packing material 62 securely in its sealing position. The gland follower 65 is in turn bolted to the gland mounting plate 61 to form a complete gland plate assembly. Of course, the packing material 62, while forming a leak-tight seal, is arranged to permit a relative sliding movement between the lance tube support 13*a* and feed pipe 59.

In accordance with a significant feature of the invention, novel ring bushings 66, 67 are arranged at spaced positions around the feed pipe 59 and are received in annular lands 68, 69, respectively, formed on the interior surfaces of the lance tube support 13*a*. As discussed above and generally illustrated in FIGS. 1A and 1B partially in phantom, the lance tube 13 is arranged in a curved configuration outside the boiler which tends to create large radial forces between the lance tube support 13*a* and co-axial feed pipe 59. These forces are distributed primarily through the bushings interposed between the lance tube support 13*a* and feed pipe 59. Pursuant to the invention, the bushings 66, 67 include generally convex outer surfaces to permit slight pivoting movement between the feed pipe 59 and lance tube support 13*a* to reduce the radial forces. Moreover, the convex surfaces act to provide a greater surface area through which the radial forces may be distributed. Thus, the novel, convex bushings 66, 67 greatly reduce friction and wear and tear on the feed pipe 59 to facilitate improved working operation and longer worklife for the soot blower 10.

As another feature of the invention, each of the bushings 66, 67 include a curved recess 71 whereby a set screw 72 may be threadedly received through the lance tube support 13*a* and screwed down to engage the bushing 66, 67 at the recess 71. Accordingly, a fine adjustment may be made to the axial setting of the bushing 66, 67 in accordance with the actual environment of the particular soot blower 10.

V. REVOLVING ROLLER ASSEMBLY

Positioned at the forwardmost end of the soot blower 10, adjacent the boiler opening (not shown), is a revolving roller assembly 73. The assembly 73 comprises a main support frame 74 which rotatably mounts a set of rollers 75 and includes upstanding front and rear walls 77, 78. A web-like circular frame 76 is positioned within the support frame 74 and rests upon the rollers 75. In this manner, the frame 76 is rotatably mounted within the support frame 74 by the rollers 75. Pursuant to the invention, three axles 79, 80, 81 are mounted within the web of the circular frame 76. The axles 79, 80, 81 are positioned to define angles of approximately 60° with respect to one another and each rotatably supports a roller 82, 83, 84 including a generally concave outer surface.

Figure 6:
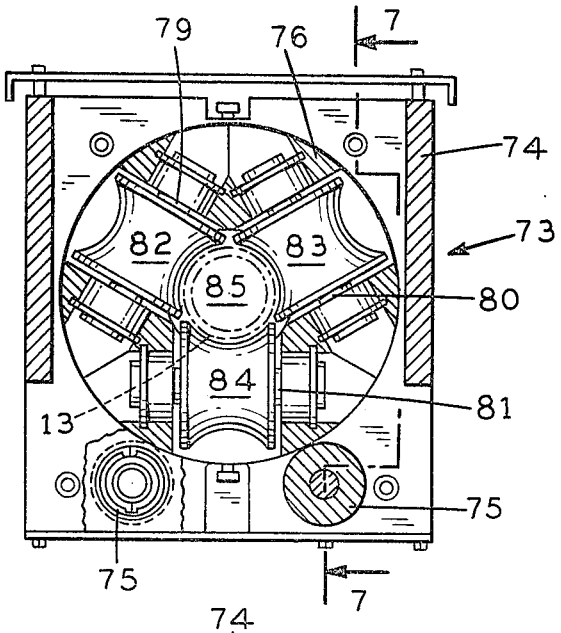
FIG. 6 is an end view partially in cross section of a revolving roller assembly used in conjunction with the cable drive system.
Figure 7:
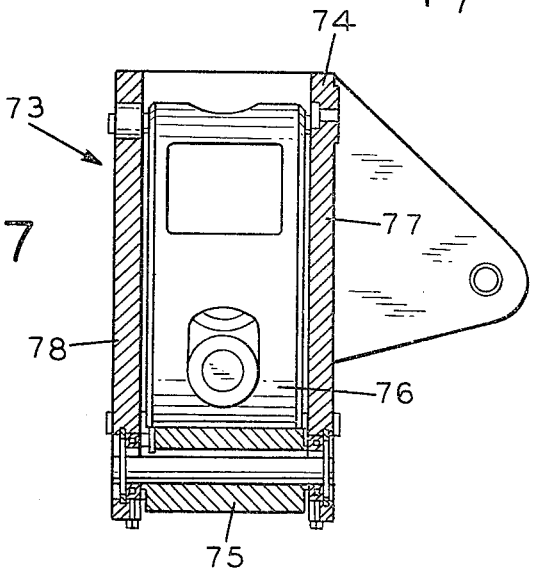
FIG. 7 is a side view partially in cross section of the revolving roller assembly of FIG. 6.

As clearly illustrated in FIG. 6, the above-described arrangement of rollers 82, 83, 84 provides a central opening 85 arranged to receive the lance tube 13. Accordingly, as the lance tube 13 is moved into and out of the boiler by the cable drive system, it will be supported and guided by the rotatable rollers 82, 83, 84 with a minimal amount of friction. Moreover, when the motor 23 is operated to rotate the lance tube 13, the lance tube 13 will cause the circular frame 76 to rotate upon the roller 75 rather than rotate within the opening 85 defined by three supporting rollers 82, 83, 84 to greatly reduce friction between the lance tube 13 and the revolving roller assembly 73.

VI. VALVE AND VALVE ACTUATOR

Figure 8:
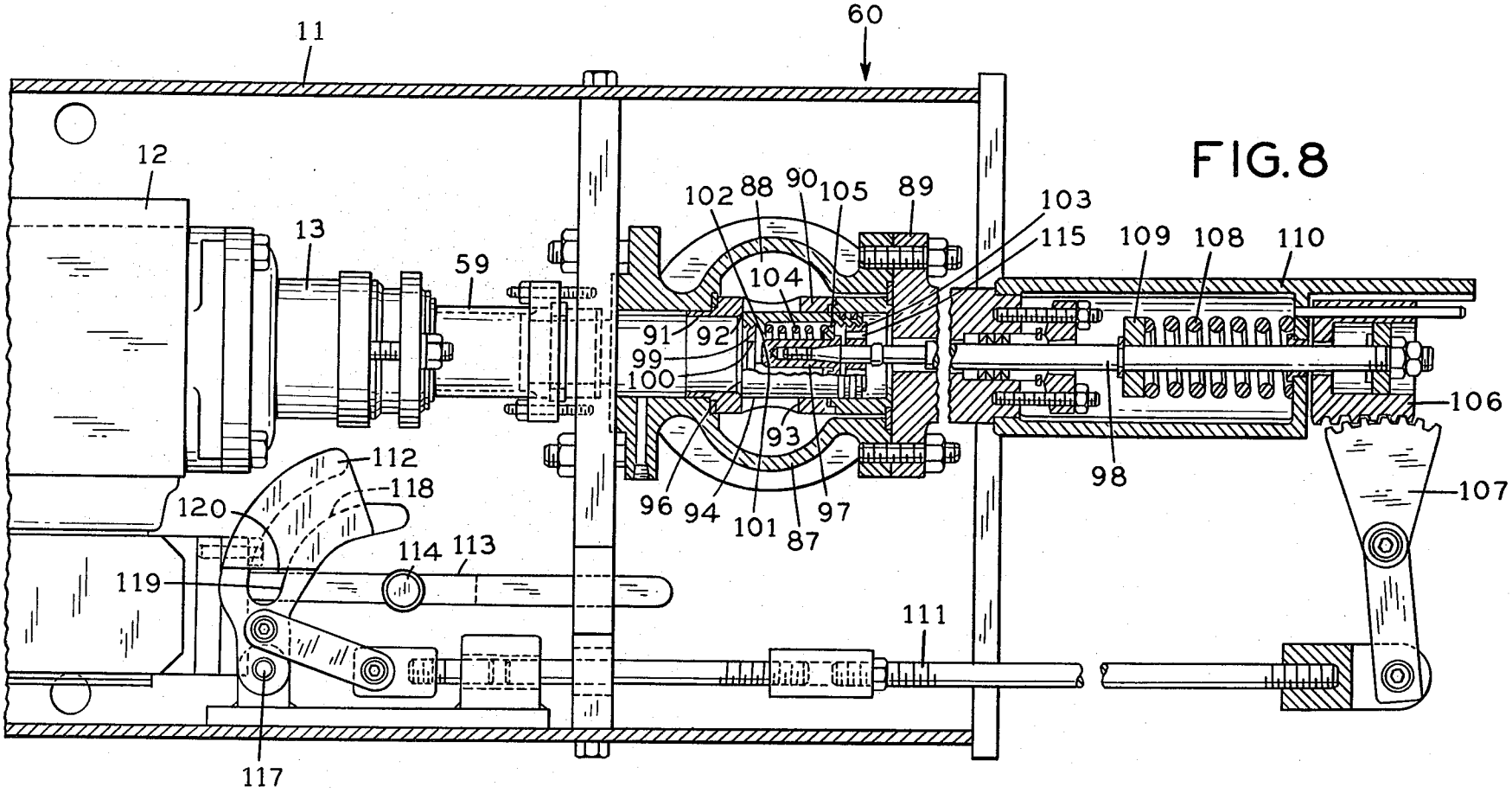
FIG. 8 is a plan view partly in cross section of the novel valve and valve actuator assembly of the present invention.

Referring now to FIG. 8, the feed pipe 59 is in fluid communication with the outlet passage 86 of a valve housing 87. The valve housing 87 includes an internal web portion 88 which is in fluid communication with both the outlet passage 86 and a source of cleaning fluid, such as water, air and/or steam (not specifically illustrated). A bonnet 89 is mounted over the top of the valve housing 87 in a sealed relation to the internal web portion 88 whereby a sealed fluid path is formed from the source of cleaning fluid to the interior of the feed pipe 59. A cylindrical member 90 is mounted within the internal web portion 88 with one end in a sealed relation to the bonnet 88 and the other end thereof including an extension 92 of reduced diameter which is received within the outlet passage 86. An annular valve seat 92 is formed within the cylindrical member 90 and openings 93 are formed through the walls of the cylindrical member 90 to provide fluid communication between the internal web portion 88 and the outlet passage 86 through the cylindrical member 90.

Pursuant to the invention, a tandem valve plug 94 is arranged for controlled axial movement within the cylindrical member 90. The valve plug comprises a generally hollow, cylindrical main plug member 95 which includes a tapered valve surface 96 formed at the lowermost end thereof. The tapered surface 96 is arranged to mate with the annular valve seat 92 when the main valve plug member 95 is in its lowermost position to close the valve. An inner plug member 97 is axially received within the main plug member 95 and is fixedly secured to the end of the valve stem 98 arranged for controlled axial movement, as will appear. The generally hollow main valve plug member 95 includes an inwardly extending, integral annular member 99 which defines a relatively small circular opening 100. The circular opening 100 includes a tapered valve seat 101 arranged to form a normally mating relation with a tapered annular valve surface 102 formed at the lowermost end of the inner plug member 97. In this manner, fluid ordinarily does not flow through the hollow main valve plug 95.

A bushing 103 is threadedly mounted within the main valve plug member 95 at the topmost end thereof and is provided with fluid flow openings 115. Unbalanced high pressure normally maintains the valve plug 94 in the closed position. Moreover, a coil spring 104 is arranged in a co-axial relation to the inner plug member 97 and acts between the annular member 99 and a collar 105 secured to the topmost portion of the inner plug member 97 to resist movement of inner plug 97 within the main plug 95 away from the valve seat 101 to prevent fluid leakage through the main valve plug 95 and insure the unbalanced state of the plug. To further help maintain the valve in a closed position, a coil spring 108 is mounted in a co-axial relation to the valve stem 98 and acts between a collar 109 rigidly secured to the valve stem 98 and a housing 110 enclosing the valve stem 98. The spring is arranged to resist any opening movement of the main valve plug 95.

In accordance with a feature of the invention, a rack-forming, cup-shaped member 106 is securely mounted to the upper end of the valve stem 98 and is in meshing engagement with a pinion-forming, rotatable lever 107 to form a valve actuator mechanism. As clearly illustrated in FIG. 8, one end of the pinion-forming lever 107 is connected via a rod-locking linkage system 111 to a cam member 112 pivotally mounted on a pin support 117. The traveling carriage assembly 12 includes a cam actuator arm 113 provided with a cam roll bearing 114 which co-acts with the cam member 112 as the traveling carriage 12 is moved in a soot blowing operation.

At the commencement of forward movement of the traveling carriage 12, by operation of the cable drive system, the cam roll bearing 114 is received within a generally curved cam slot 118 formed within the cam member 112 by sliding over the surface 120 into a cam-receiving portion 119. The forward movement of the carriage 12 will operate to cause the cam roll bearing 114 to pivot the cam member 112 in a counter-clockwise direction about the pin support 117 whereby the rod-locking linkage system 111 is moved to the left to rotate pinion-forming rotatable lever 107 in the clockwise direction. This causes the rack-forming, cup-shaped member 106 to move to the right thereby displacing the valve stem 98 to lift the inner plug member 97 away from the valve seat 101. Consequently, high pressure fluid from the source of cleaning fluid will now be able to flow through the hollow main valve plug 95 thereby equalizing the high pressure effects on both sides of the main valve plug 95. Continued forward movement of the traveling carriage 12 will move the cam roll bearing 114 further to the right causing the cam 112 to be pivoted to its forwardmost "locked" position before the cam roll bearing 114 passes by the cam 112. The final pivoting movement of the cam 112 causes the valve stem 98 to continue its leftward movement whereby the inner plug member 97 will engage the bushing 103 to easily lift the now-balanced main valve plug 95 from the valve seat 92 to fully open the valve, whereby the cleaning fluid may be discharged from the feed pipe 59 to the interior of the lance tube 13.

The valve will remain in the open position until the traveling carriage 12 is returned by the cable drive system to its rearwardmost position within the housing 11. Just prior to arrival of the carriage 12 at the rearwardmost position, the cam roll bearing 114 will be received within the cam slot 118 (the cam being pivoted to its locked position wherein the opening of the slot 118 is in alignment with the path of travel of the cam roll bearing 114). When the cam roll bearing 114 approaches the closed end of the slot 118, it will tend to pivot the cam 112 in a clockwise direction unlocking the cam and moving the rod linkage 111 to the right. As should be understood, the rightwardmost position of the rod 111 rotates the pinion-forming lever 107 in a counter-clockwise direction thereby moving the valve stem to the left to move the inner valve plug 97 to its mating relation with the valve seat 102 and thereafter to move the main valve plug 95 to its mating relation with the main vlve seat 92 to fully close the valve. The cam roll bearing 114 will move out of the slot 118 of the cam by riding up along the surface 120.

VII. CONCLUSION

The present invention provides a highly advantageous integrated system for accomplishing a soot blowing operation within a public utility boiler or the like. Each of the various components of the system facilitates ease of operation for the overall system with maximum efficiency and worklife potential. For example, the cable drive system offers a straightforward traverse drive for the lance tube while the tandem valve plug arrangement permits an easy translation of the traveling carriage movement via the cam and linkage rods for valve opening and closing operations. Moreover, the revolving roller assembly and cable guide rollers greatly reduce friction on the lance tube and undesirable harmonics in the cables during horizontal movement of the lance tube to provide a minimal energy requirement to move the lance tube. All of the various features, when coupled with the feed pipe bushings, offer effective soot blowing to maximize the efficient operation of a public utility boiler thereby achieving energy conservation in the production of energy.

The above-described preferred embodiment of the invention is meant to be representative only as certain changes therein may be made by persons skilled in the art without departing from the clear teachings of the invention. Accordingly, reference should be made to the following appended claims in determining the full scope of the invention.

I claim:

1. In a soot blower of the long retracting type including a traveling carriage rotatably supporting a lance tube and movable along a path of travel between a forwardmost working position and a rearwardmost non-working position, means to impart traverse motion to said traveling carriage, which comprises (a) a motor means, (b) a rotatable drum-like element operatively asociated with said motor means, (c) a first cable including one end fastened to said rotatable drum-like element, (d) said first cable extending from said drum-like element around a pulley mounted at said rearwardmost non-working position to said traveling carriage, (e) said first cable including a second end fastened to said traveling carriage, (f) a second cable including an end fastened to said rotatable drum-like element, (g) said second cable extending from said drum-like element around a pulley mounted at said forwardmost working position to said traveling carriage, (h) said second cable including a second end fastened to said traveling carriage whereby said fastened ends of said first and second cables are fastened to said traveling carriage on opposite sides thereof.

(i) said rotatable drum-like element being positioned at a location adjacent said path of travel midway between said forwardmost working position and said rearwardmost non-working position, (j) each of said first and second cables being wound through several complete turns about said rotatable drum-like element, (k) said cables being arranged and configured whereby rotation of said drum-like element will take up one of said cables onto said element and unwind the other of said cables from said element, (l) said cable being taken up by said element acting to pull said carriage, (m) whereby each of said first and second cables is of the shortest practicable length relative to the distance between the forwardmost working position and the rearwardmost non-working position.

2. The means to impart transverse motion to said traveling carriage according to claim 1, further characterized by (a) said soot blower including a longitudinally extending housing, (b) said traveling carriage being mounted for longitudinal motion within said housing, (c) said housing including a support platform mounted thereupon at a location midway between said forwardmost and rearwardmost positions, and (d) said rotatable drum-like element being rotatably mounted upon said support platform.

3. The means to impart traverse motion to said traveling carriage according to claim 2, further characterized by (a) said rotatable drum-like element including a helical groove formed across the surface thereof to receive said first and second cables.

4. The means to impart traverse motion to said traveling carriage according to claim 1, further characterized by (a) at least one laterally movable roller assembly associated with said rotatable drum-like element, (b) said roller assembly being movable along a path of travel which is parallel to the longitudinal axis of said rotatable drum-like element, and (c) said roller assembly including a pulley rotatable about an axis parallel to said longitudinal axis of said drum-like element, (d) said pulley engaging at least one of said first and second cables whereby said roller assembly will guide said engaged cable to said drum-like element upon rotation thereof.

5. The means to impart traverse motion to said traveling carriage according to claim 4, further characterized by (a) a longitudinally extending track mounted adjacent said drum-like element, (b) said roller assembly including wheels arranged to engage said track for longitudinal motion, (c) whereby said roller assembly may be positioned along said track in accordance with the longitudinal position of said engaged cable.

6. The means to impart traverse motion to said traveling carriage according to claim 1, further characterized by (a) said motor means comprising a reversible electric motor mechanically coupled with said rotatable drum-like element, (b) said electric motor being operative to selectively rotate said drum-like element.

7. In a soot blower of the long retracting type including a traveling carriage rotatably supporting a lance tube and movable between a forwardmost working position and a rearwardmost non-working position, means to impart traverse motion to said traveling carriage which comprises (a) a motor means, (b) a rotatable drum-like element operatively associated with said motor means, (c) a first cable including one end fastened to said rotatable drum-like element, (d) said first cable extending from said drum-like element around a pulley mounted at said rearwardmost non-working position to said traveling carriage whereby rotation of said drum-like element in a first direction will cause said first cable to move said traveling carriage rearwardly toward said rearwardmost non-working position, (e) a second cable operatively engaging said rotatable drum-like element, (f) said second cable extending from said drum-like element around a pulley mounted at said forwardmost working position to said traveling carriage whereby rotation of said drum-like element in a second direction will cause said second cable to move said traveling carriage forwardly toward said forwardmost working position, (g) cable engaging means associated with said drum-like element, (h) said cable engaging means comprising at least one track element mounted adjacent said rotatable drum-like element and extending parallel to the longitudinal axis of said drum-like element and a roller assembly movably mounted upon said track-like element, (i) said roller assembly including a pulley rotatably supported by said roller assembly, (j) said pulley including a cable receiving portion, (k) said cable receiving portion of said pulley being arranged and configured with respect to said rotatable drum-like element whereby at least one of said first and second cables is received in said cable receiving portion in a taut condition whereby said last-mentioned pulley dampens any vibrations which may develop in the engaged cable to facilitate a smooth motion for the cable as it moves onto or off the rotatable drum-like element.

* * * * *